US005401576A

United States Patent [19]

Yoon et al.

[11] Patent Number: 5,401,576

[45] Date of Patent: * Mar. 28, 1995

[54] HEAT- AND CHEMICAL-RESISTANT ACRYLIC SHORT FIBERS WITHOUT SPINNING

[75] Inventors: Han S. Yoon; Tae W. Son; Byung C. Kim; Byung G. Min, all of Seoul; Jae W. Cho, Anyang; Chul J. Lee, Seoul, all of Rep. of Korea

[73] Assignee: Korea Institute of Science and Technology, Seoul, Rep. of Korea

[ * ] Notice: The portion of the term of this patent subsequent to Jun. 15, 2010 has been disclaimed.

[21] Appl. No.: 64,345

[22] Filed: May 20, 1993

Related U.S. Application Data

[63] Continuation of Ser. No. 804,457, Dec. 10, 1991, abandoned.

[30] Foreign Application Priority Data

Mar. 27, 1991 [KR] Rep. of Korea ..... 91-4820

[51] Int. Cl.[6] ..... D02G 3/00

[52] U.S. Cl. ..... 428/35.9; 428/357; 428/364; 162/157.4; 162/157.5

[58] Field of Search ..... 428/357, 359, 364, 373; 162/157.4, 157.5; 264/210.7, 206, 342 RB, 291; 526/341

[56] References Cited

U.S. PATENT DOCUMENTS

| | | | |
|---|---|---|---|
| 2,999,788 | 9/1961 | Morgan | 162/157.4 |
| 3,486,970 | 12/1969 | Troemel et al. | 162/157.4 |
| 3,770,856 | 11/1973 | Ueki et al. | 162/157.5 |
| 3,984,601 | 10/1976 | Blickenstaff . | |
| 4,140,844 | 2/1979 | Lohwasser | 428/364 |
| 4,163,770 | 8/1979 | Porosoff | 264/210.3 |
| 5,219,501 | 6/1993 | Yoon et al. | 264/85 |

FOREIGN PATENT DOCUMENTS 62-149908 3/1987 Japan .

OTHER PUBLICATIONS

B. G. Frushour, "A New Thermal Analytical Technique for Acrylic Polymers", *Polymer Bulletin 4,* pp. 305–314 (1981).

*Primary Examiner*—N. Edwards

*Attorney, Agent, or Firm*—Oblon, Spivak, McClelland, Maier & Neustadt

[57] ABSTRACT

A new, pulp-like, acrylic short fiber having excellent heat- and chemical-resistance is provided. The fiber has a thickness distribution of 0.1 μm to 50 μm, a length distribution of 1 mm to 20 mm, and a thermal transition temperature (Tg) of above 200° C. The fiber is produced by heating a mixture of polyacrylonitrile and water of about 5% to 100% by weight to temperatures above hydration-melting temperature under seal to an amorphous melt; cooling the resulting amorphous melt to temperatures between the melting and the solidifying temperatures of the melt to form a supercooled melt; extruding the resulting supercooled melt to give extrudates; heat-stabilizing the resulting extrudates at temperatures between 180° C. and 300° C. for 1 minute to 4 hours after drying and drawing; and cutting and beating the resulting heat-stabilized extrudates into an appropriate size.

5 Claims, 14 Drawing Sheets

HEAT- AND CHEMICAL-RESISTANT ACRYLIC SHORT FIBERS WITHOUT SPINNING

This application is a Continuation of application Ser. No. 07/804,457, filed on Dec. 10, 1991, now abandoned.

BACKGROUND OF THE INVENTION

1. Field of the Invention

The present invention relates to a novel, pulp-like acrylic short fiber. More particularly, the invention relates to a novel, heat- and chemical-resistant acrylic short fiber produced by melt extruding polyacrylonitrile (hereinafter, referred to as PAN) hydrate followed by heat stabilizing the resulting extrudate without spinning.

2. Description of the Prior Art

Acrylic fibers have been spotlighted as materials of clothings as well as, more recently, industrial materials such as substitute fibers for asbestos, heat insulating and resisting fibers, cement reinforcing fibers and the like. Such acrylic fibers to be used as industrial materials should, however, be produced in the form of a short fiber.

Short fibers have hitherto been produced in the form of a staple by solution spinning methods wherein a solvent is used and the resulting fibers are drawn to form long fibers followed by cutting the long fibers into staples.

Such prior art methods for producing short fibers suffer from the defects that due to the use of a solvent, various complicated steps of extracting, recovering and purifying the solvent, and preventing an environmental pollution are essentially involved; thus, an economic load undertaken is very large, and environmental pollution problems may have also been caused. Furthermore, short fibers in the form of a staple cannot fully satisfy various properties and characteristics required in an industrial material, such as reinforcing, heat insulating and binding properties.

According to prior art processes for the preparation of acrylic fibers, fibers having molecular orientation could not have been prepared without filament spinning through microholes followed by drawing in a high draw ratio. Furthermore, molecular-oriented, pulp-like fibers could have been prepared only by complicated processes comprising various steps of preparing a spinning solution, spinning, solidifying, removing and recovering a solvent, drawing, cutting, fibrillating and the like.

It is well known that PAN molecular chains are twisted into the form of an irregular helix due to strong polarity of nitrile groups in the side chains thereof and have characteristics closely allied to rigid chains; see W. R. Krigbaum et al., Journal of Polymer Science, Vol. XLIII, pp 467–488 (1960). If a strong polar solvent, such as dimethylformamide, dimethylacetamide, dimethylsulfoxide, or aqueous NaSCN solution, aqueous $ZnCl_2$ solution or aqueous $HNO_3$ solution is added to such PAN, the nitrile groups attract the molecules of these solvents to combine therewith, and thereby the groups are separated from each other to form a fluid solution even at room temperature.

If the resulting fluid solution is extruded through microholes in a spinning die, and then the solvent is removed, PAN is solidified to take the form of a fiber. However, molecular chains in the solidified PAN still form an original, non-oriented lump in which they are bound with each other. Therefore, the resulting filaments are deemed to be present in the form of a fiber immediately after spinning. However, if the solvent is removed and then the filaments are dried, the PAN molecular chains in the filaments are reconglomerated to form a non-oriented lump after all since internal molecular chains in the resulting filaments have not been oriented at all. Accordingly, in order to obtain a complete fibrous structure from the viewpoint of molecular construction, it is necessary to draw the resulting filaments in a high draw ratio of above 5 to 30 so that the molecular chains are arranged in parallel with the fiber axis. As the filaments are drawn, the conglomerated PAN molecular chains are become disentangled and extended out while arranging with each other, resulting in the formation of the fibers having an extended chain crystal region. As discussed above, the step of drawing is indispensable in the prior art techniques for producing fibers, and therefore the substantial fiber structure in which most molecular chains are oriented in parallel with the fiber axis cannot be obtained until the resulting filaments are subjected to drawing.

Various processes for the preparation of fibers which comprise forming a melt by heating a mixture of PAN and water, followed by extruding the resulting melt have been proposed, for example, in U.S. Patent No. 2,585,444. However, according to such processes, for the easier spinning of a melt, it is necessary to lower the viscosity of the melt. Therefore, the amorphous melt cannot help being obtained at a high temperature at which a crystalline phase is broken down, and then the resulting melt is subjected to spinning. Thus, PAN molecular chains oriented in parallel with each other cannot be obtained until the resulting filaments are subjected to drawing in a high draw ratio.

For example, U.S. Pat. No. 2,585,444 teaches that PAN fibers can be produced by heating PAN hydrate containing 30% to 85% by weight of water to a temperature above its melting point to give a melted fluid followed by melt spinning the resulting fluid. U.S. Pat. Nos. 3,896,204 and 3,984,601 disclose processes for the production of fibers which comprise heating a mixture of PAN and water of about 20% to 30% by weight to a temperature ranging from 170° C. to 205° C. to give an amorphous melt, and spinning the resulting melt followed by drawing in a draw ratio of 5 or more to obtain fibers. The above patents also teach that if the content of acrylonitrile in PAN is as low as 80%, the step of spinning can be carried out at a temperature ranging from 140° C. and 170° C. However, as can be seen in FIG. 3, since the higher the content of a comonomer except for acrylonitrile is, the lower the temperature at which amorphous melt is formed is, PAN containing about 20% by weight of the comonomer can be transformed into an amorphous melt even at 140° C.

Therefore, within the temperature range and under the spinning conditions mentioned above, a melted metacrystalline phase having a highly-oriented molecular structure cannot be obtained.

U.S. Pat. Nos. 3,991,153 and 4,163,770 disclose processes for the production of fibers which comprise spinning PAN hydrate containing 10% to 40% by weight of water at temperatures above its melting temperature, that is, the temperature range in which a melt of an amorphous, single phase is formed, and then drawing the resulting extruded filaments in a draw ratio of 25 to 150 in a pressure chamber. In these cases, since PAN molecular chains in the melt exist in an irregular and random state, a fibrous structure is not formed until drawing is applied in a high draw ratio.

As mentioned above, conventional processes typically involve the steps of forming and spinning a PAN/-$H_2O$ melt. However, since the spinning is carried out in the temperature range in which all melts exist in a random state, good orientation of PAN molecular chains cannot be obtained until the extruded filaments are drawn in a high draw ratio.

U.S. Pat. Nos. 3,402,231, 3,774,387 and 3,873,508 also disclose processes for the production of fibers for pulp, which comprise adding water of 100% or more to PAN to form a PAN mixture, heating the resulting mixture at about 200° C. to form a melt, and then spinning the resulting melt to produce fibers. However, since in these patents an excess of water and elevated temperatures are used in order to obtain the PAN mixture, the resulted PAN/$H_2O$ melt takes a random, amorphous form as well as PAN filaments extruded therefrom are no more than a non-oriented, continuous foam which does not practically have neither the orientation of molecular chains nor a fibrous structure, although they appear to be formed into the form of a fiber externally.

As mentioned above, the conventional techniques characterized by melt spinning of PAN hydrate have been dependent on a usual process which comprises forming an amorphous melt by using an excess of water, or by heating PAN hydrate to temperatures above its melting temperature, or by increasing the content of a comonomer, spinning the resulting amorphous melt to form filaments, and then drawing the resulting filaments in a high draw ratio to form fibers.

SUMMERY OF THE INVENTION

Considering the defects from which the prior art techniques suffer, the present inventors have intensively studied on the two-component system comprising PAN and water and have found the unexpected facts that, as can be seen in FIG. 1A, the PAN/$H_2O$ mixture absorbs heat of fusion to form a melt of an amorphous, single phase at its melting temperature. The single phase melt, even if cooled to temperatures below its melting temperature, is not solidified and still maintains its supercooled, melted state without being crystallized until the cooling temperature arrives at a selected temperature range (OR). When further cooled to temperatures below its solidifying temperature (Tc), PAN is crystallized and is returned to its original state. However, when cooled to form the supercooled state, PAN/$H_2O$ melt forms a kind of metacrystalline phase having a molecular order as it is in the single phase, unlike the amorphous melt formed at elevated temperatures. The physical properties of the metacrystalline phase are similar to those of an liquid crystalline phase. Such a phenomenon in which PAN, together with water, forms a metacrystalline phase having physical properties similar to those of a liquid crystal below the melting temperature of PAN hydrate is first found by the present inventors. This surprising phenomenon allows PAN to easily have a molecular orientation upon extruding, as seen in FIG. 4. PAN molecular chains in the melted metacrystalline phase have a self-orienting property. Thus, if some oriented shear forces are applied to the melted metacrystalline phase by mechanical extrusion operation, PAN molecules easily form a highly-oriented fibrous structure. In other words, if the melted metacrystalline phase is extruded, the extended PAN molecular chains approach transversely with each other, while water contained in the system is automatically expelled off so that the fibrous structure is formed and highly-oriented fibers may be formed without a separate drawing process.

Therefore, the primary object of the present invention is to provide a new, pulp-like, acrylic short fiber from polyacrylonitrile.

Another object of the invention is to provide a new, pulp-like, acrylic short fiber which is very suitable for an engineering material such as a substitute fiber for asbestos, a heat insulating and resisting fiber, a cement reinforcing fiber and so forth.

A further object of the invention is to provide a new, heat- and chemical-resistant, pulp-like acrylic short fiber produced by a process characterized by simplifying the complicated processes essentially required in the prior art processes including spinning, and comprising heat stabilizing of the resulting extrudate.

These and other objects of the present invention will become apparent by referring to the illustration in the attached drawings and the following detailed description of the invention.

DETAILED DESCRIPTION OF THE INVENTION

Figure 1A:
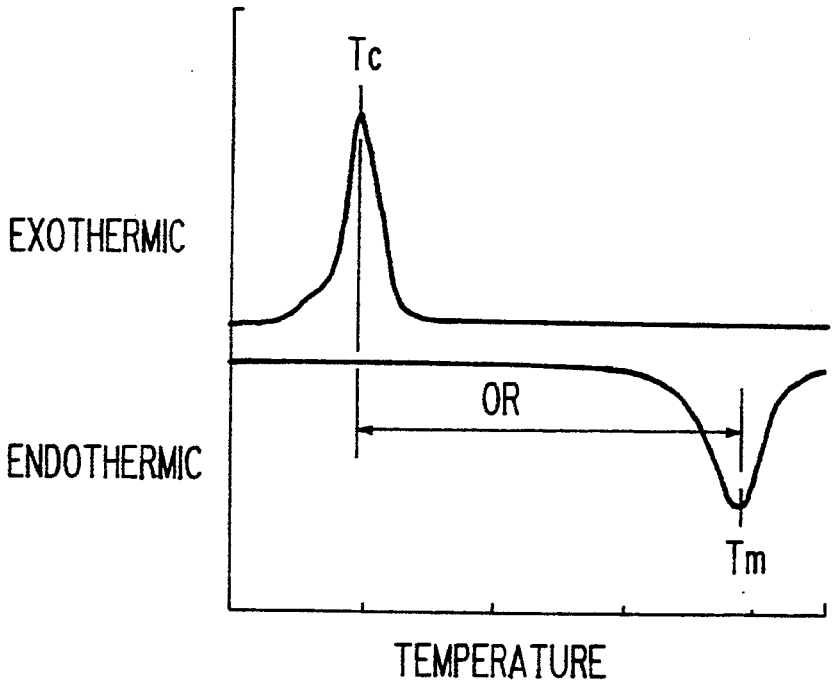
FIG. 1A illustrates typical melting endothermic and solidifying exothermic peaks obtained from differential thermal analysis of polyacrylonitrile hydrate, which indicates that the temperature range (OR) in which a melt of metacrystalline phase having a molecular order can be formed resides between the melting and the solidifying temperatures of the PAN hydrate.

According to the present invention, a new, pulp-like, acrylic short fiber having excellent heat- and chemical-resistance is produced by heating a mixture of PAN consisting of 70% or more by weight of acrylonitrile and 30% or less by weight of a copolymerizable monomer and having a viscosity average molecular weight of 10,000 to 500,000, and 5% to 100% by weight of water in an enclosed container to form an amorphous PAN/-$H_2O$ melt; cooling the resulting amorphous melt to temperatures between the melting and the solidifying temperatures of the melt to form a supercooled melt of a melted metacrystalline phase having characteristics similar to those of a liquid crystal and molecular order; extruding the resulting supercooled melt through an extrusion die having a proper size to give highly-oriented extrudates in which platen fibrils are uniformly laminated by spontaneous discharge of water and solidification of the resulting extrudates, while a fiber structure is being formed; and heat-stabilizing the resulting extrudates at temperatures between 180° C. and 300° C. for 1 minute to 5 hours followed by cutting and beating the resulting heat-stabilized extrudates into an appropriate size to give pulp-like short fibers.

The term "PAN" as used herein refers to both homopolymers of acrylonitrile and copolymers of acrylonitrile with one or two or more copolymerizable monomers. Such copolymers should contain at least 70%, preferably 85% by weight of acrylonitrile and at most 30%, preferably 15% by weight of the copolymerizable monomer.

Such copolymerizable monomers include addition polymerizable monomers containing ethylenically double bonds, such as methyl acrylate, methyl methacrylate, ethyl acrylate, chloroacrylic acid, ethyl methacrylate, acrylic acid, methacrylic acid, acrylamide, methacrylamide, butyl acrylate, methacrylonitrile, butyl methacrylate, vinyl acetate, vinyl chloride, vinyl bromide, vinyl fluoride, vinylidene chloride, vinylidene bromide, allyl chloride, methyl vinyl ketone, vinyl formate, vinyl chloroacetate, vinyl propionate, styrene, vinyl stearate, vinyl benzoate, vinyl pyrrolidone, vinyl piperidine, 4-vinyl pyridine, 2-vinyl pyridine, N-vinyl phthalimide, N-vinyl succinimide, methyl malonate, N-vinyl carbazol, methyl vinyl ether, itaconic acid, vinylsulfonic acid, styrene-sulfonic acid, allylsulfonic acid, methallylsulfonic acid, vinyl furan, 2-methyl-5-vinyl pyridine, itaconic ester, chlorostyrene, vinylsulfonate salt, styrenesulfonate salt, allylsulfonate salt, methallylsulfonate salt, vinylidene fluoride, 1-chloro-2-bromoethylene, α-methylstyrene, ethylene and propylene.

The molecular weight of PAN is given as a viscosity average molecular weight (Mv) from an intrinsic viscosity ($\eta$) determined in N,N-dimethylformamide solution according to the following equation:

$$[\eta]=3.35\times10^{-4}\,Mv^{0.72}$$

wherein the intrinsic viscosity $[\eta]$ is determined at 30° C. in a solution of PAN in N,N-dimethylformamide as a solvent; see T. Shibukawa et al., Journal of Polymer Science, Part A-1, Vol. 6, pp 147–159 (1968).

The molecular weight of polyacrylonitrile used in the present invention ranges from 10,000 to 500,000, preferably from 50,000 to 350,000, as a viscosity average molecular weight calculated from the intrinsic viscosity of PAN.

Figure 2A:
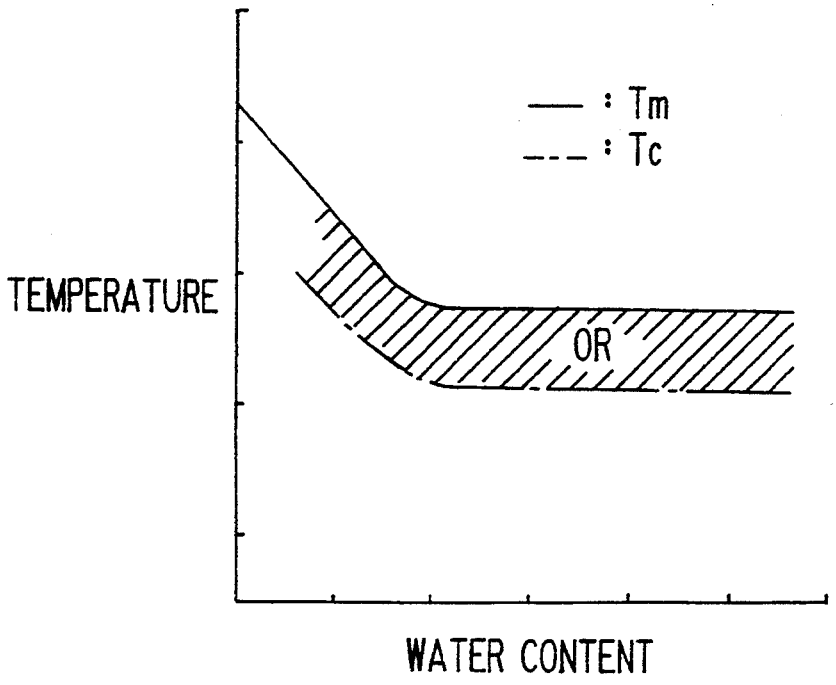
FIG. 2A is a graph illustrating typical changes in the melting and the solidifying temperatures of polyacrylonitrile hydrate depending on the water content, which indicates the temperature region in which the melted metacrystalline phase having molecular order characteristics similar to those of a liquid crystal is formed.

Determination of phase changes by differential scanning calorimetry, depending on the water content in hydrate, temperatures and PAN composition, can provide information on the existence of the temperature region in which a melted metacrystalline phase is formed, as illustrated in FIGS. 1A and 2A. In the meantime, the two-component system consisting of PAN and water begins to change its phase at temperatures higher than the boiling point of water under normal pressure. It is therefore possible to obtain the melting endothermic and solidifying exothermic peaks when elevating a temperature and cooling, respectively, using a large-volume, pressure-resisting capsule which is also perfectly sealed and is capable of withstanding under high pressure (Perkin-Elmer part 319-0128). As indicated in FIG. 1A, when apexes of the endothermic and the exothermic peaks indicate the melting temperature (Tm) and the solidifying temperature (Tc), respectively, the temperature range between the melting and the solidifying temperatures corresponds to the temperature region in which a melted metacrystalline phase is formed.

Figure 1B:
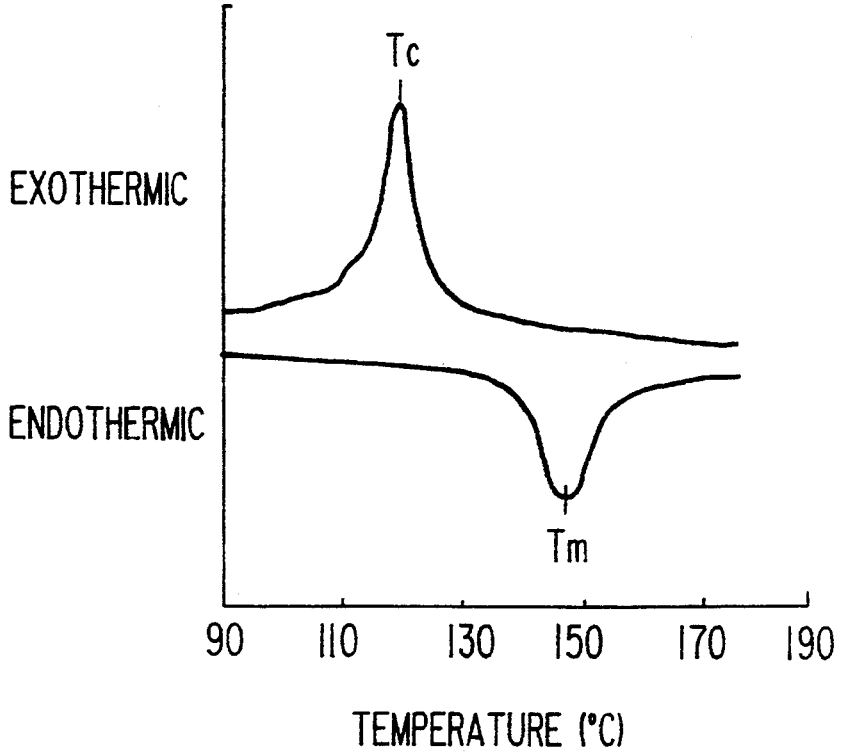
FIG. 1B illustrates an embodiment as shown in FIG. 1A, which shows the melting endothermic and the solidifying exothermic peaks of the PAN hydrate which is a mixture of a polyacrylonitrile containing 89.2% by weight of acrylonitrile and 10.8% by weight of methylacrylate, and 20% by weight of water.
Figure 2B:
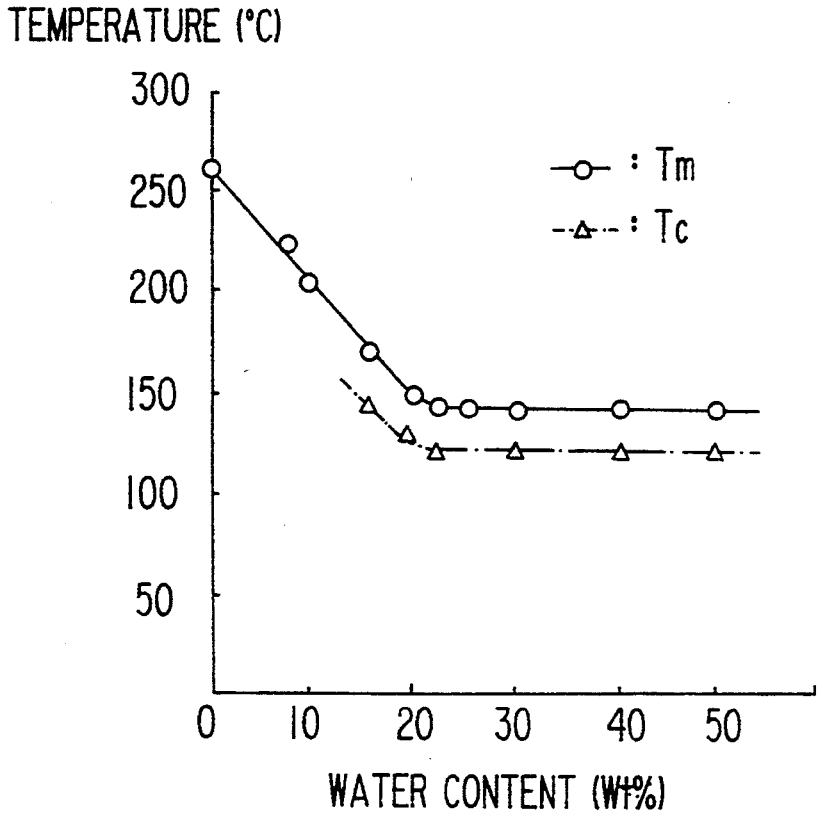
FIG. 2B illustrates an embodiment as shown in FIG. 2A, which indicates changes in the melting and the solidifying temperatures of the polyacrylonitrile hydrate containing 89.2% by weight of acrylonitrile and 10.8% by weight of methylacrylate, depending on the water content.

FIG. 2A is a diagram illustrating changes of the temperature region in which a melted metacrystalline phase is formed, depending on the water content. FIGS. 1B and 2B are the embodiments of FIGS. 1A and 2A, respectively, and illustrate changes of the temperature region wherein the melted metacrystalline phase is formed, depending on the water content. FIG. 1B is a case wherein 20% by weight of water is mixed with PAN containing 89.2% by weight of acrylonitrile and 10.8% by weight of methacrylate, and FIG. 2B is a case wherein the same PAN as used in FIG. 1B is employed; however the amount of water to be mixed with PAN is changed within the range of 5% to 50% by weight.

Figure 4:
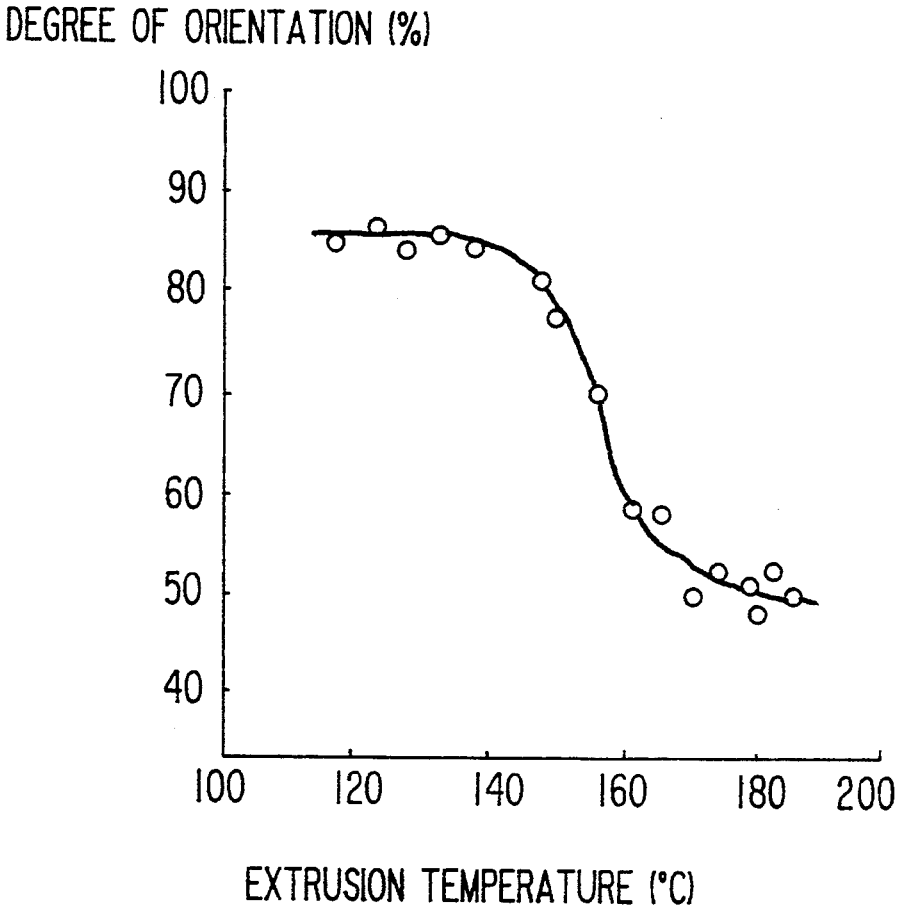
FIG. 4 is a graph illustrating changes in the degree of orientation of an extrudate produced by extruding a melt of a polyacrylonitrile hydrate, depending on the extrusion temperature of the melt, from which it can be seen that in the temperature range in which an amorphous melt is formed, a substantially non-oriented extrudate is obtained, i.e., the degree of orientation acquired is below about 50%, while in the temperature range in which a melted metacrystalline phase is formed, an extrudate having high molecular orientation is obtained, i.e., the degree of orientation acquired is 80% or more.

When a hydrate formed by addition of an appropriate amount of water to PAN is placed in a pressure-resistant container and heated to temperatures above its melting temperature, polymers are associated with water molecules to form a PAN/$H_2O$ melt, while autogeneous water vapor pressure is generated. Alternatively, while heating the hydrate, an inert gas, such as nitrogen or argon, may be introduced into the container to maintain it in a pressurized condition. The temperatures to be heated must reach the melting temperature (Tm) or more as indicated in FIG. 1A. The resulting melt is a random, amorphous fluid. If the amorphous melt is cooled to and maintained at temperatures between the melting and the solidifying temperatures of the melt as indicated in FIG. 2A, a supercooled melt of a metacrystalline phase having physical properties similar to those of a liquid crystal is formed. It is believed that the melted metacrystalline phase is a kind of supercooled melt which exists in the form of a fluid without being solidified even below its melting temperature and has not a random amorphous phase but a regular phase having molecular order. It appears that in the regular phase, extended PAN molecular chains are arranged in parallel with each other by their interaction with water molecules. The regular phase has a self-molecular orienting characteristic as can be seen in a liquid crystal. That is, as seen in FIG. 4, if an extrusion is carried out at elevated temperatures at which an amorphous melt is formed, substantially non-oriented extrudates having the degree of orientation of about 50% or less are formed. While, if the extrusion is carried out at lower temperatures at which a melted metacrystalline phase is formed, a high degree of orientation of about 80% or more is accomplished under the same extrusion conditions.

Figure 3:
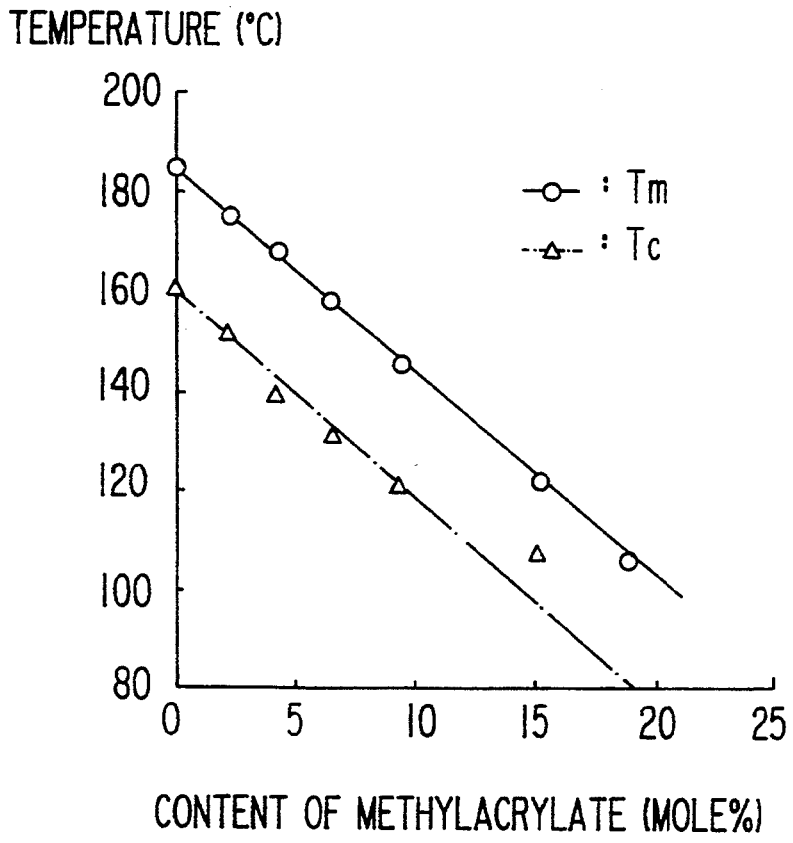
FIG. 3 is a graph illustrating changes in the melting and the solidifying temperatures of a polyacrylonitrile hydrate depending on the content of methylacrylate as a comonomer, from which it can been seen that as the methylacrylate content in the polyacrylonitrile increases, the melting and the solidifying temperatures of the polyacrylonitrile hydrate are lowered.

The temperature range within which a melted metacrystalline phase having the molecular order can be formed depends on the acrylonitrile content in PAN, as seen in FIG. 3, or the water content in hydrate, as seen in FIG. 2A. However, the range resides always between the melting and the solidifying temperatures of the melt, as indicated in FIG. 1A. While the PAN/$H_2O$ melt is being formed, a pressure applied to a pressure-resistant container may be a water vapor pressure which is spontaneously generated depending on the relevant temperatures. Alternatively, the container may be pressurized with a pressure of 1 to 50 atm. The water content in the melt is preferably in the range of 5% to 100%, more preferably 10% to 50% by weight.

Since in a random, amorphous PAN/$H_2O$ melt, individual molecular chains move more freely, they are irregularly conglomerated, and thus, the molecules fail to establish molecular order. If the amorphous melt is cooled to and is maintained within a proper temperature range, the individual molecular chains are subjected to inhibition and restriction in their movements due to intermolecular attraction existing between PAN molecular chains and water molecules; thereby they form a extended chain conformation and are arranged orderly in parallel with adjacent molecular chains to form a melted metacrystalline phase, in which a mutual distance between molecules is maintained constantly. In the melted metacrystalline phase thus formed, PAN molecular chains maintain their molecular order, and thus, have difficulty in moving independently. However, when the whole molecular chains which have been formed in a regular phase are moved towards a selected direction, it appears that PAN molecular chains are easy to have a three-dimensional orientation structure. On the other hand, since in an amorphous melt, individual PAN molecular chains move independently and freely, the order between molecular chains cannot be formed as well as molecular chains as such are freely wrinkled and are in existence as they are conglomerated, and thus, it is impossible to arrange the molecular chains in a selected direction.

Since the supercooled melt of the metacrystalline phase according to the present invention has a self-molecular orienting property as can be seen in a liquid crystal, PAN molecular chains can form a fiber structure of high orientation and are formed into highly-oriented extrudates having a cross-sectional structure in which platen fibrils are uniformly laminated even by a simple extrusion process employing a piston-type extruder.

In addition to the piston-type extruder, a ram- or screw-type extruder may be used as an extruder. A slit die, a round die, a tube die or an arc-type die may be employed as an extrusion die. The thickness/length ratio of the extrusion die is above 1. The higher ratio is effective in obtaining high orientation. Extrusion temperature is maintained at a constant temperature between the melting and the solidifying temperatures of the relevant PAN hydrate. Extrusion conditions are controlled so that the internal pressure of an extruder can be maintained at least at an autogeneous water vapor pressure so as to extrude a melt into an atmosphere at room temperature and under normal pressure at an output rate of 1 mm per second or more and to take-up the resulting continuous extrudates at a linear rate above the output rate. The output rate/take-up rate ratio is above 1. The higher ratio is advantageous in improving the degree of orientation.

Figure 5:
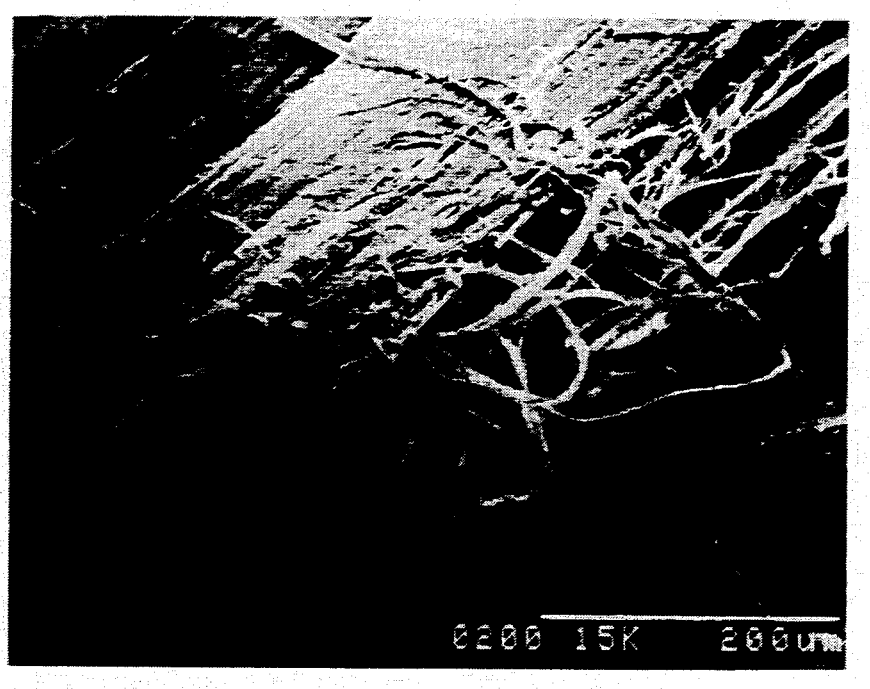
FIG. 5 is a scanning electron photomicrograph showing the cross and the longitudinal sections of a tape-shaped extrudate obtained by extruding a melt metacrystalline phase through a slit die, which shows that the extrudate has a sectional structure on the cross-section in which platen fibrils are uniformly laminated on the sides of the space from which water has been drained away, and an internal structure on the longitudinal section in which individual fibrils are redivided into microfibrils to form fibers.
Figure 6:
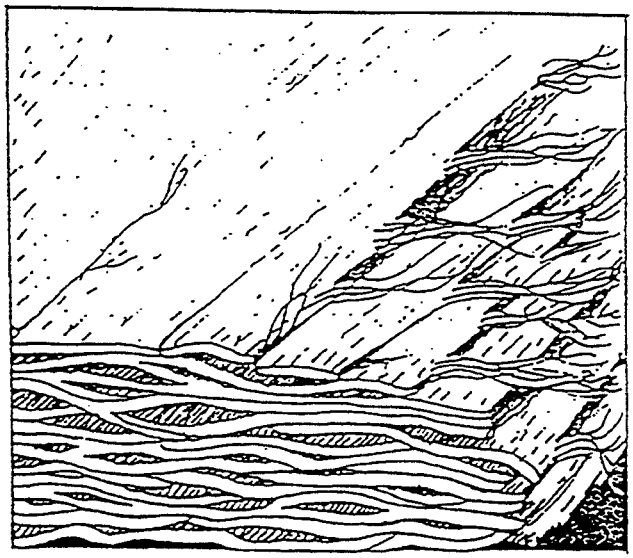
FIG. 6 illustrates a model of the cross-section and the longitudinal section structures of the tape-shaped extrudate as shown in FIG. 5, from which it can be seen that the extrudate has a sectional structure on the cross-section in which platen fibrils are uniformly laminated at proper intervals and an internal structure on the longitudinal section in which the platen fibrils consist of numerous microfibrils which can be easily divided into to form individual fibers.

As described above., extrusion of a melted metacrystalline phase followed by solidification of the resulting extrudates provides tape-shaped extrudates consisting of microfiber bundles and having a sectional structure on the cross-section, in which platen fibrils are arranged and laminated uniformly on both sides of the space from which water is separated and removed, i.e., dehydration space, and an internal structure on the longitudinal section, from which it can be seen that the individual fibrils are redivided into microfibrils to form fibers, as illustrated in FIG. 5. These platen fibrils have a thickness of 1 μm to 10 μm and are made up of microfibrils having a thickness of 0.01 μm to 1.0 μm and being clustered tightly.

Figure 7:
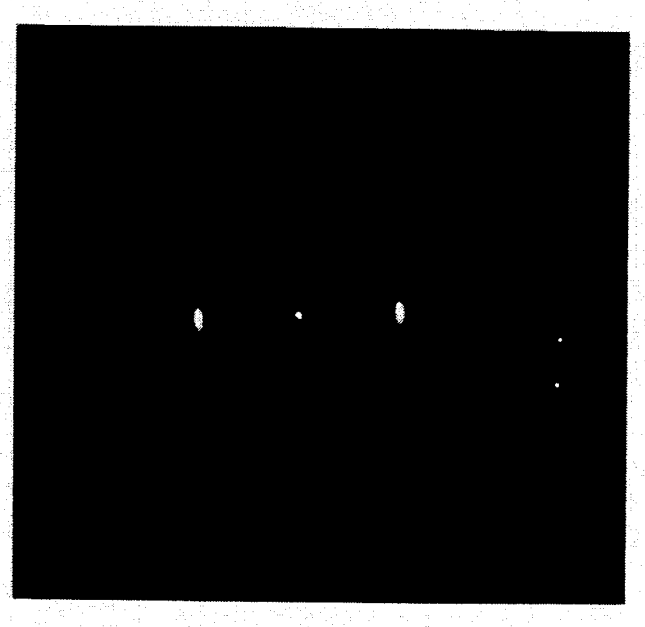
FIG. 7 is an X-ray diffraction photograph of the tape-shaped extrudate as shown in FIG. 5, which shows that the extrudate has fibrous crystal and highly-oriented structures.
Figure 8:
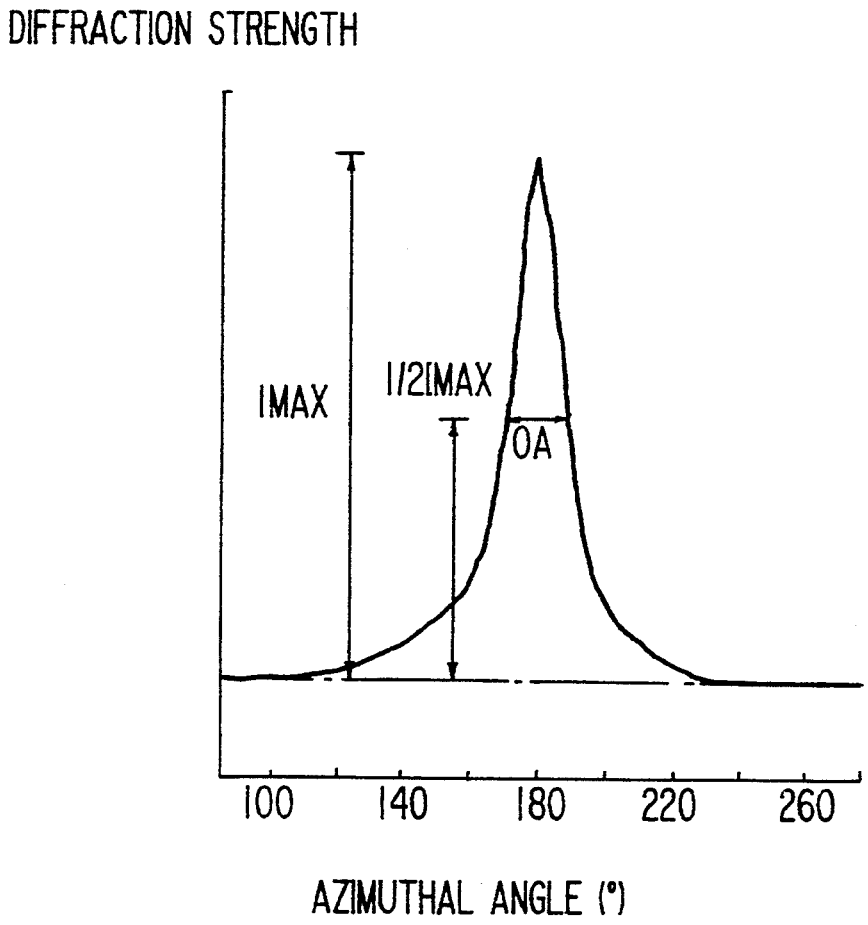
FIG. 8 illustrates a diffraction strength curve as scanned in the azimuthal direction at the peak position ($2\theta=16°$) of the main diffraction appearing in the direction of the equator on the diffraction photograph as shown in FIG. 7, which shows that a high degree of molecular orientation is obtained.
Figure 9:
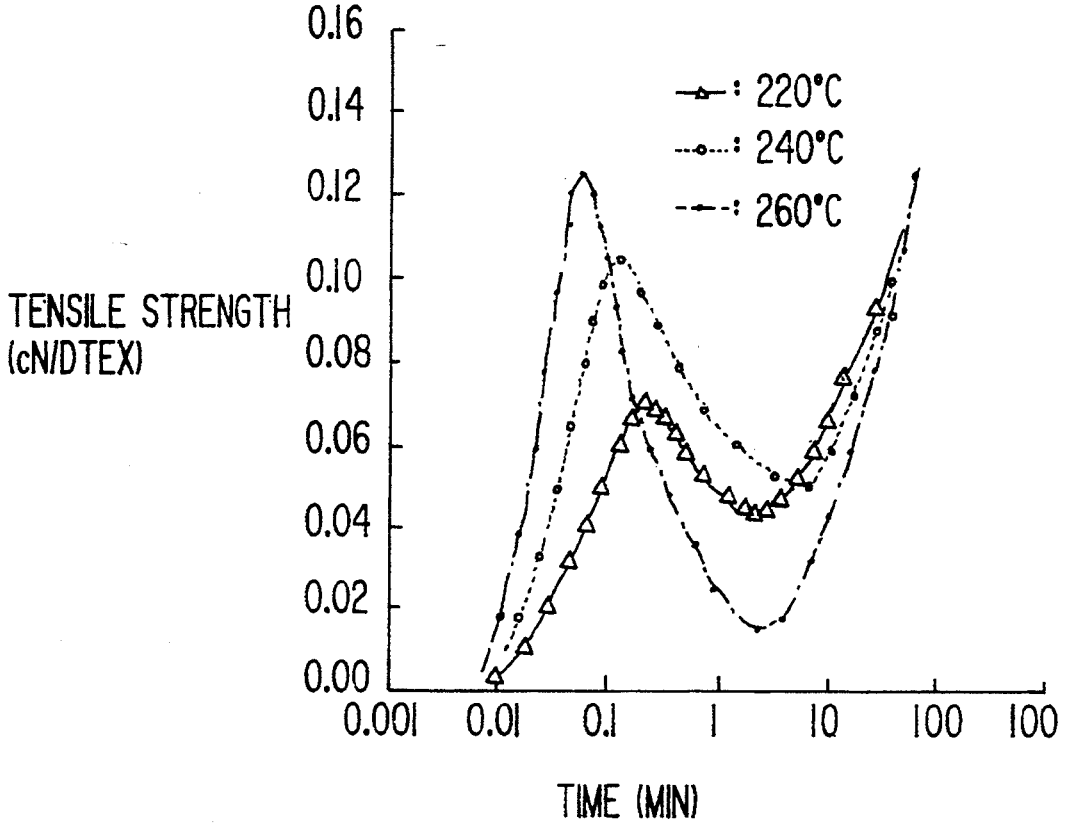
FIG. 9 illustrates a graph plotting tensile strength applied to the extrudate as shown in FIG. 5 versus temperatures of a high temperature furnace and the passing time of the extrudate through the furnace.

From the X-ray diffraction patterns of the tape-shaped extrudates, it is possible to identify that the fibrils and microfibrils have the fibrous crystals and highly-oriented structures, as seen in FIG. 7, and that they have the orientation degree of 70% or more calculated from a half-maximum width (OA) according to the following equation:

$$\text{Degree of orientation (\%)} = \frac{180 - OA}{180} \times 100$$

wherein OA is a peak width at the one half value of diffraction strength as scanned in the azimuthal direction at the peak position ($2\theta = 16.2°$) of the main diffraction appeared in the direction of the equator on the diffraction pattern, as shown in FIG. 8.

In order to improve the orientation degree, the continuous extrudates thus prepared are passed, in a tensioned state, between a high temperature rollers, which is under an high-temperature, gaseous atmosphere maintained at temperatures of 100° C. to 180° C., or to which compressive force is applied, to subject them to drying and drawing. During the drying and drawing, residual moisture is removed and a draw effect of 5% to 100% to the original length is obtained. Consequently, extrudates made up of well-developed fibrils are prepared.

Then, the continuous extrudates thus dried are subjected to heat-stabilizing by passing them through a high-temperature furnace maintained at temperatures of 180° C. to 300° C. The furnace is divided into three or more temperature zones having a temperature gradient under which the temperatures is higher at the outlet side zone than at the inlet. These zones also have independently a temperature sensor and a temperature regulator so that temperatures in the respective zones can be constantly maintained. The heat-stabilization is performed using the inlet and the outlet rollers which are controlled at the same speed so that the resulting tapes have a constant length.

Figure 10:
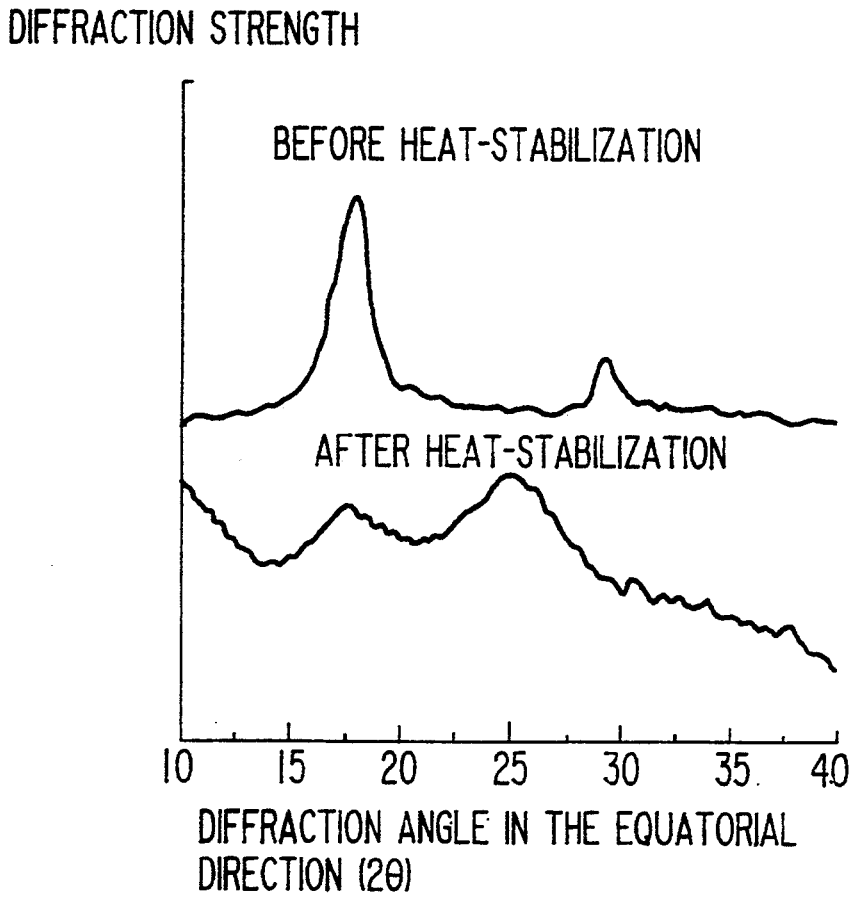
FIG. 10 illustrates diffraction strength curves of a PAN extrudate observed in the direction of the equator by an X-ray diffraction analysis for the purpose of analyzing a change in the internal crystal structure of the PAN extrudate made by heat stabilizing process, which show that as the heat stabilizing reaction progresses, the intrinsic diffraction peak of PAN appearing at $2\theta=16°$ gradually disappears, while a new peak appears and is gradually strong at $2\theta=26°$.
Figure 11:
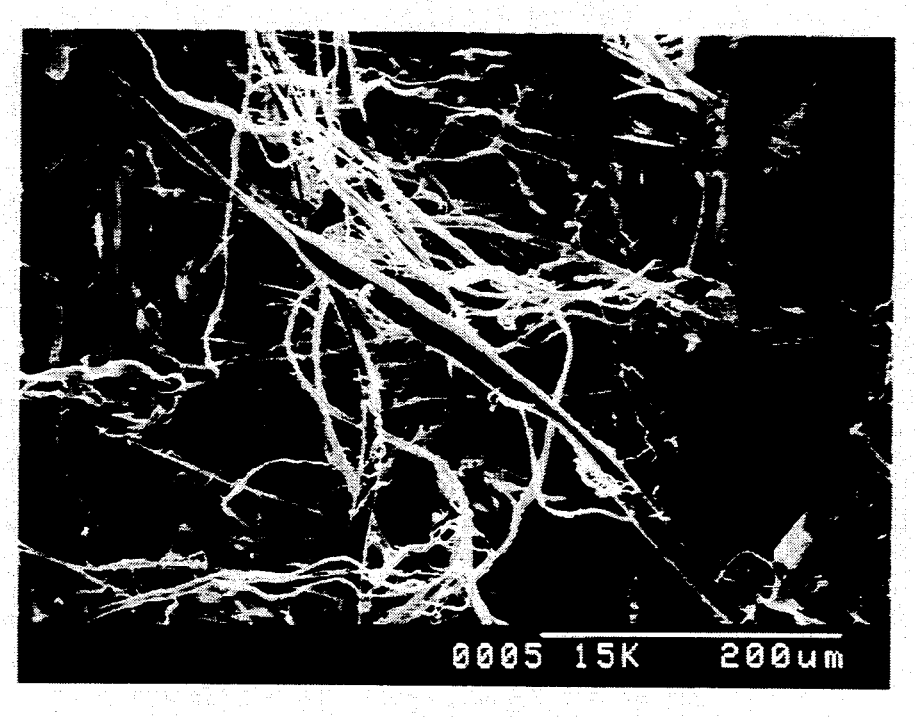
FIG. 11 is a scanning electron microscopic photograph of pulp-like short fibers produced by cutting heat-stabilized extrudates into an appropriate length followed by beating, which shows that the pulp-like shoft fibers consist of thin and long microfibrils having a thickness distribution of 0.1 μm to 20 μm and an axis ratio (L/D) is above 10.

The continuous extrudates undergo considerable tension while passing the high-temperature furnace. FIG. 10 illustrates changes in tension applied to the extrudates, depending on the furnace temperature and the passing time. In the early stage, the tension is gradually increased. However, after the lapse of a given time, the tension again begins to be relaxed. As the heat-stabilization further lasts, numerous nitrile groups are cyclized and at the same time the tension largely increases. This phenomenon is identical to the general one presented when in order to prepare a carbon fiber from PAN fiber, PAN fiber is subjected to heat-stabilization. If during the heat-stabilization, the tension applied to an extrudate is larger than its tensile strength, the extrudate is cut off. Therefore, the temperature gradient of a furnace and the heat-stabilization time should be set up under a good grasp of a tension distribution depending on the time and the temperature. Heat-stabilization tests are carried out with varying conditions. It has been found that the higher furnace temperature makes the cutting phenomenon presented during the heat-stabilization worse. Generally, if the furnace temperature is above 300° C., it is difficult to continuously carry out the heat-stabilization.

The starting temperature of heat-stabilization, as determined by Differential Scanning Calorimeter (DSC), slightly varys depending on the kind and the content of the used comonomer, but generally ranges from 200° C. to 240° C. The heat-stabilization is exothermic, and thus generates considerable heat. Thus, unless the temperature and the time of heat-stabilization are properly controlled, it causes the resulting extrudates melted and cut.

Considering the above, the preferred temperature for heat-stabilization ranges from 200° C. to 240° C. at the inlet zone, and from 240° C. to 280° C. at the outlet zone of a furnace, respectively. As for the heat-stabilization time, the heat-stabilization reaction starts within 1 minute, and after the lapse of 5 hours, it nearly reaches an equilibrium.

As the heat-stabilization reaction progresses, the outward color of the extrudates is changed to dark brown or black via yellowish brown.

In order to investigate the change of an internal crystalline structure of extrudates by the heat-stabilization, the diffraction of the extrudates in the direction of equator has been observed by an X-ray diffraction analysis. The result showed that the intrinsic diffraction peak of PAN appearing at $2\theta = 16°$ becomes gradually disappeared while at $2\theta = 26°$ a new peak appears and becomes gradually strong. From this, it can be seen that PAN molecular structure is chemically modified by the heat-stabilization reaction, and that its internal physical structure also is therefore transformed into another form.

Figure 12:
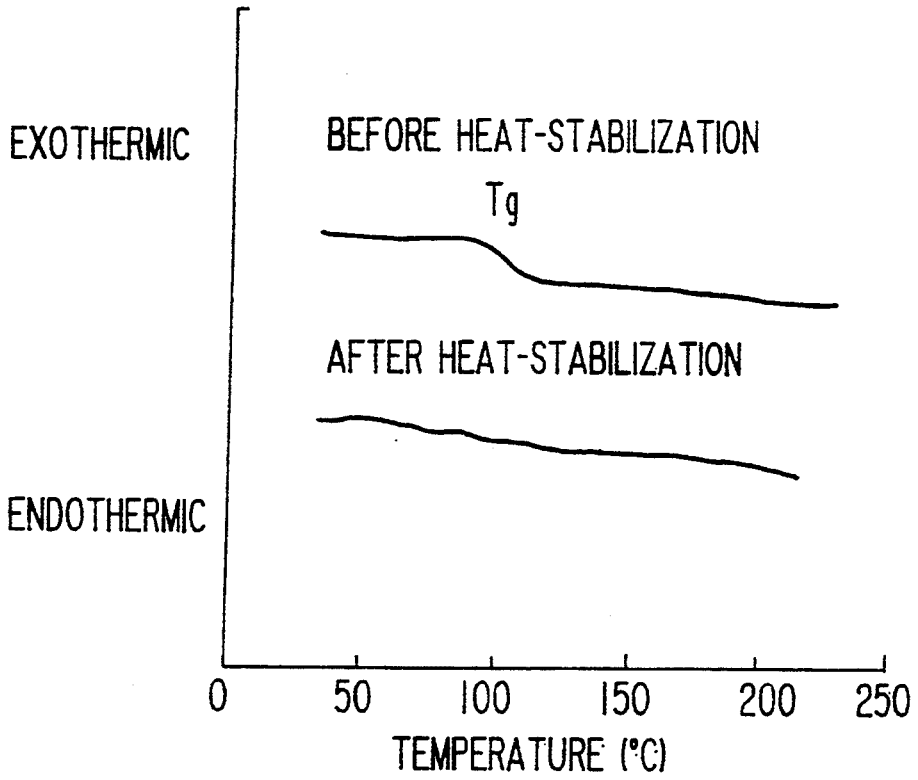
FIG. 12 illustrates curves for acrylic pulp derived from DSC thermal analysis showing thermal properties of acrylic pulp produced through heat stabilizing process, which show that a glass transition temperature of unheat-stabilized acrylic pulp is observed in the neighborhood of 90° C., while heat-stabilized pulp is so heat-resistant that it does not exhibit any thermal transition at temperatures below 200° C.

The heat-stabilized, continuous extrudates are cut into an appropriate length, and then beated to prepare pulp-like short fibers as shown in FIG. 12, like before the heat-stabilization. A size of short fibers depends on the cut length and beating conditions. The pulp-like short fibers thus prepared consist of microfibrils having a highly-oriented fibrous structure, and have a thickness distribution of 0.1 μm to 100 μm and a length distribution of 0.1 mm to 100 mm.

Thermal properties of acrylic pulp prepared through the heat-stabilization have been investigated by DSC thermal analysis. As illustrated in FIG. 12, a glass transition temperature (Tg) of unheat-stabilized acrylic pulp is observed in the neighborhood of 90° C., while heat-stabilized acrylic pulp is so heat-resistant that its Tg is not observed below 200° C. Density is also increased from 1.15 g/cm$^3$ before the heat-stabilization to 1.25 g/cm$^3$ after the heat-stabilization. Further, heat-stabilized acrylic pulp comes to have a network molecular structure due to cyclization and cross-linkage, and its solubility to a solvent is therefore sharply lowered. This makes the pulp chemical-resistant so that it is not dissolved in a PAN solvent at all.

According to the present invention, a heat-resistant, pulp-like, acrylic short fiber is produced by an epochal, simple process, which comprises melt extruding a mixture of PAN and small amount of water as a comelt followed by heat-stabilization. Therefore, the production cost is considerably cut down, and environmental pollution problems are also solved. The produced short fiber per se is characterized by its structure consisting of highly-oriented fibrils. The pulp-like short fiber of the invention has very excellent physical properties, and heat- and chemical-resistant characteristics. In addition, the pulp-like short fiber of the invention consists of numerous microfibrils, and therefore has a very large surface area, and irregular surface and sectional structures. This allows the pulp-like short fiber to have a very excellent bonding property to other materials. Thus, the heat-resistant, pulp-like short fiber of the invention possesses optimum conditions required as a short fiber material such as a composite material, a heat insulating and resisting material, a cement reinforcing material, and the like.

DESCRIPTION OF THE PREFERRED EMBODIMENT

The invention will be illustrated in greater detail by way of the following examples. The examples are presented for illustrative purposes and should not be construed as limiting the invention which is properly delineated in the claims.

EXAMPLE 1

A mixture of 30 g of water and 100 g of an acrylonitrile copolymer having a chemical composition of 93.5% of acrylonitrile and 6.5% of methylacrylate, and a viscosity average molecular weight of 154,000, was compressed and placed into a cylinder of an extruder, which was equipped with the cylinder, a piston and a slit die and which could be sealed, heated and kept at a constant temperature. The mixture was heated to 180° C. under applied pressure of 5 kg/cm$^2$ to form a complete melt. Then, the temperature of the extruder was reduced to 150° C. Maintaining this temperature, the melt was pressurized to 60 kg/cm$^2$ by operating the piston, and extruded through the slit die having 0.50 mm/20 mm/3 mm in thickness/width/length into an atmosphere at room temperature and normal pressure to produce continuous, tape-shaped extrudates. The extrudates were taken up at a rate of 10 m/min. The structure of the produced extrudates was observed by a scanning electron microscope. The results showed that the exturdates had a sectional structure in which platen fibrils having a thickness of 1 μm to 10 μm were uniformly laminated in the sides of the dehydration space, and an internal structure in which individual fibrils were divided into innumerable microfibrils having a thickness of 0.01 μm to 1.0 μm. According to an X-ray diffraction analysis, it was found that the tape-shaped extrudates had a fibrous crystalline structure and the degree of orientation of 89%. The continuous tape-shaped extrudates were divided finely in their length directions to form long fibers. Mechanical properties of the resulting long fibers were measured. The results were as follows: tensile strength, 3.6 g/denier; elongation at breakage, 11%; and tensile modulus, 60 g/denier. These tape-shaped, continuous extrudates were passed under tension through between two rollers which were maintained at 150° C. and to which compressive force was also added, and then dried and drawn. Then, the extrudates were passed through a tube-type, high-temperature furnace having three temperature zones maintained at 220° C., 240° C. and 270° C., respectively for 30 minutes to subject them to heat-stabilization. The heat-stabilized, tape-shaped, continuous extrudates were cut into 20 mm in length and beated using a beater to produce pulp-like short fibers. The short fibers thus produced possessed a thickness distribution of 0.1 μm to 50 μm and a length distribution of 1 mm to 20 mm. It was also found that the heat-stabilized acrylic pulp was so heat- and chemical-resistant that its thermal transition temperature was not observed below 200° C. and it was not dissolved in dimethylformamide at all.

EXAMPLE 2

A mixture of 33 g of water and 100 g of an acrylonitrile homopolymer having a viscosity average molecular weight of 120,000 was compressed and placed into a cylinder of an extruder, which was equipped with the cylinder, a piston and a slit die and which could be sealed, heated and kept at a constant temperature. The mixture was heated to 200° C. under applied pressure of 5 kg/cm$^2$ to form a complete melt. Then, the temperature of the extruder was reduced to 178° C. Maintaining this temperature, the melt was pressurized to 70 kg/cm$^2$ by operating the piston and extruded through the slit die having 0.50 mm/20 mm/2 mm in thickness/width/length into an atmosphere at room temperature and under normal pressure to produce continuous tape-shaped extrudates. The resulting extrudates were taken up at a rate of 5 m/min. These continuous extrudates were passed under tension through between two rollers which were maintained at 170° C. and to which compressive force was applied, and dried and drawn. Then, the extrudates were passed through a tube-type, high-temperature furnace having three temperature zones maintained at 220° C., 240° C. and 270° C., respectively, for 60 minutes to subject them to heat-stabilization. The heat-stabilized, continuous, tape-shaped extrudates were cut into 20 mm in length, followed by beating using a beater to produce pulp-like short fibers. The short fibers thus produced possessed a thickness distribution of 0.1 μm to 50 μm and a length distribution of 1 mm to 20 mm. It was also found that the heat-stabilized acrylic pulp was so heat- and chemical-resistant that its glass transition temperature was not observed below 200° C. and it was not dissolved in dimethylformamide at all.

EXAMPLE 3

A mixture of 30 g of water and 100 g of an acrylonitrile copolymer having a chemical composition of 94.2% of acrylonitrile and 5.8% of methylacrylate and a viscosity average molecular weight of 178,000 was compressed and placed into a cylinder of an extruder, which was equipped with the cylinder, a piston and a round-shaped die and which could be sealed, heated and kept at a constant temperature. The mixture was heated to 180° C. under applied pressure of 5 kg/cm$^2$ to form a complete melt. Then, the temperature of the extruder was reduced to 155° C. Maintaining this temperature, the melt was pressurized to 60 kg/cm$^2$ by operating the piston and extruded through a 1.5 mm calibered die to produce continuous tape-shaped extrudates having a thickness of 3 mm and a round section. The resulting extrudates were taken up at a rate of 15 m/min. These continuous extrudates were passed under tension through between two rollers, which were maintained at 170° C. and to which compressive force was applied, and dried and drawn. Then, the extrudates were passed through a tube-type, high-temperature furnace having three temperature zones maintained at 230° C., 250° C. and 270° C., respectively, for 60 minutes to subject them to heat-stabilization. The heat-stabilized, tape-shaped extrudates were cut into 20 mm in length, followed by beating using a beater to produce pulp-like short fibers. The short fibers thus produced possessed a thickness distribution of 0.1 μm to 50 μm and a length distribution of 1 mm to 20 mm. It was also found that the heat-stabilized acrylic pulp was so heat- and chemical-resistant that its glass transition temperature was not observed below 200° C. and it was not dissolved in dimethylformamide at all.

EXAMPLE 4

A mixture of 25 g of water and 100 g of an acrylonitrile copolymer having a chemical composition of 88.6% of acrylonitrile and 11.4% of methacrylate and a viscosity average molecular weight of 215,000 was compressed and placed into a cylinder of an extruder, which was equipped with the cylinder, a piston and a slit die and which could be sealed, heated and kept at a constant temperature. The mixture was heated to 175° C. under applied pressure of 5 kg/cm$^2$ to form a complete melt. Then, the temperature of the extruder was reduced to 145° C. Maintaining this temperature, the melt was pressurized to 50 kg/cm$^2$ by operating the piston and extruded through the slit die having 1 mm/20 mm/3 mm in thickness/width/length to produce continuous tape-shaped extrudates. The resulting extrudates were taken up at a rate of 10 m/min. These continuous extrudates were passed under tension through between two rollers which were maintained at 140° C. and to which compressive force was applied, and dried and drawn. Then, the extrudates were passed through a tubetype, high-temperature furnace having three temperature zones maintained at 220° C., 240° C. and 260° C., respectively, for 60 minutes to subject them to heat-stabilizing. The heat-stabilized, continuous, tape-shaped extrudates were cut into 20 mm in length, followed by beating using a beater to produce pulp-like short fibers. The short fibers thus produced possessed a thickness distribution of 0.1 μm to 50 μm and a length distribution of 1 mm to 20 mm. It was also found that the heat-stabilized acrylic pulp was so heat- and chemical-resistant that its glass transition temperature was not observed below 200° C., and it was not dissolved in dimethyl-formamide at all.

EXAMPLE 5

A mixture of 32 g of water and 100 g of an acrylonitrile copolymer having a chemical composition of 94.8% of acrylonitrile and 5.2% of vinylacetate and a viscosity average molecular weight of 125,000 was compressed and placed into a cylinder of an extruder, which was equipped with the cylinder, a piston and a slit die and which could be sealed, heated and kept at a constant temperature. The mixture was heated to 180° C. under applied pressure of 5 kg/cm$^2$ to form a complete melt. Then, the temperature of the extruder was reduced to 155° C. Maintaining this temperature, the melt was pressurized to 65 kg/cm$^2$ by operating the piston and extruded through the slit die having 0.50 mm/15 mm/2 mm in thickness/width/length to produce continuous, tape-shaped extrudates. The resulting extrudates were taken up at a rate of 7 m/min. These continuous extrudates were passed under tension through between two rollers which were maintained at 170° C. and to which compressive force was applied, and dried and drawn. Then, the extrudates were passed through a tube-type, high-temperature furnace having three temperature zones maintained at 220° C., 250° C. and 270° C., respectively, for 60 minutes to subject them to heat-stabilization. The heat-stabilized, continuous, tape-shaped extrudates were cut into 20 mm in length, followed by beating using a beater to produce pulp-like short fibers. The short fibers thus produced possessed a thickness distribution of 0.1 μm to 50 μm and a length distribution of 1 mm to 20 mm. It was also found that the heat-stabilized acrylic pulp was so heat- and chemical-resistant that its glass transition temperature was not observed below 200° C., and it was not dissolved in dimethylformamide at all.

EXAMPLE 6

A mixture of 20 g of water and 100 g of an acrylonitrile copolymer having a chemical composition of 83.8% of acrylonitrile and 16.2% of vinylacetate and a viscosity average molecular weight of 176,000 was compressed and placed into a cylinder of an extruder, which was equipped with the cylinder, a piston and a slit die and which could be sealed, heated and kept at a constant temperature. The mixture was heated to 165° C. under applied pressure of 5 kg/cm$^2$ to form a complete melt. Then, the temperature of the extruder was reduced to 135° C. Maintaining this temperature, the melt was pressurized to 55 kg/cm$^2$ by operating the piston and extruded through the slit die having 0.1 mm/20 mm/2 mm in thickness/width/length to produce continuous tape-shaped extrudates. The extrudates were taken up at a rate of 20 m/min. These continuous extrudates were passed under tension through between two rollers which were maintained at 150° C. and to which compressive force was applied, and dried and drawn. Then, the extrudates were passed through a tubetype, high-temperature furnace having three temperature zones maintained at 210° C., 240° C. and 260° C., respectively, for 40 minutes to subject them to heat-stabilization. The heat-stabilized, continuous, tape-shaped extrudates were cut into 20 mm in length, followed by beating using a beater to produce pulp-like short fibers. The short fibers thus produced possessed a thickness distribution of 0.1 μm to 50 μm and a length distribution of 1 mm to 20 mm. It was also found that the heat-stabilized acrylic pulp was so heat- and chemical-resistant that its glass transition temperature was not observed below 200° C. and that it was not dissolved in dimethylformamide at all.

EXAMPLE 7

A mixture of 21 g of water and 100 g of an acrylonitrile copolymer having a chemical composition of 89.5% of acrylonitrile and 10.5% of styrene and a viscosity average molecular weight of 126,000 was compressed and placed into a cylinder of an extruder, which was equipped with the cylinder, a piston and a round-shaped die and which could be sealed, heated and kept at a constant temperature. The mixture was heated to 170° C. under applied pressure of 5 kg/cm$^2$ to form a complete melt. Then, the temperature of the extruder was reduced to 142° C. Maintaining this temperature, the melt was pressurized to 55 kg/cm$^2$ by operating the piston and extruded through the die having a caliber of 2 mm to produce continuous tape-shaped extrudates. The resulting extrudates were taken up at a rate of 20 m/min. These continuous extrudates were passed under tension through between two rollers which were maintained at 130° C. and to which compressive force was applied, and dried and drawn. Then, the extrudates were passed through a tube-type, high-temperature furnace having three temperature zones maintained at 220° C., 250° C., and 270° C., respectively, for 60 minutes to subject them to heat-stabilization. The heat-stabilized, tape-shaped, continuous extrudates were cut into 20 mm in length and beated using a beater to produce pulp-like short fibers. The short fibers thus produced possessed a thickness distribution of 0.1 μm to 50 μm and a length distribution of 1 mm to 20 mm. It was also found that the heat-stabilized acrylic pulp was so heat- and chemical-resistant that its glass transition temperature was not observed below 200° C. and it was not dissolved in dimethylformamide at all.

EXAMPLE 8

A mixture of 18 g of water and 100 g of an acrylonitrile copolymer having a chemical composition of 87.1% of acrylonitrile and 12.9% of methylmethacrylate and a viscosity average molecular weight of 112,000 was compressed and placed into a cylinder of an extruder, which was equipped with the cylinder, a piston and a slit die and which could be sealed, heated and kept at a constant temperature. The mixture was heated to 170° under applied pressure of 5 kg/cm$^2$ to form a complete melt. Then, the temperature of the extruder was reduced to 140° C. Maintaining this temperature, the melt was pressurized to 50 kg/cm$^2$ by operating the piston and extruded through the slit die having 0.50 mm/20 mm/2 mm in thickness/width/length into an atmosphere at room temperature and normal pressure to produce continuous tape-shaped extrudates. The resulting extrudates were taken up at a rate of 20 m/min. These continuous extrudates were passed under tension through between two rollers which were maintained at 150° C. and to which compressive force was applied, and dried and drawn. Then, the extrudates were passed through a tube-type, high-temperature furnace having three temperature zones maintained at 220° C., 250° C. and 270° C., respectively, for 60 minutes to subject them to heat-stabilization. The heat-stabilized, tape-shaped, continuous extrudates were cut into 20 mm in length and beated using a beater to produce pulp-like short fibers. The short fibers thus produced possessed a thickness distribution of 0.1 μm to 50 μm and a length distribution of 1 mm to 20 mm. It was also found that the heat-stabilized acrylic pulp was so heat- and chemical-resistant that its glass transition temperature was not observed below 200° C., and it was not dissolved in dimethylformamide at all.

COMPARATIVE EXAMPLE 1

For the purpose of a comparison, a mixture of 100 g of an acrylonitrile copolymer having a chemical composition of 92.8% of acrylonitrile and 7.2% of methylacrylate and a viscosity average molecular weight of 102,000 and 22 g of water was compressed and placed into the same extruder as employed in Example 1, and heated to 175° C. under applied pressure of 5 kg/cm$^2$ to form a complete melt. Then, the resulting melt, as it stood, was pressurized to 60 kg/cm$^2$ by operating the piston and extruded through the slit die having 0.5 mm/20 mm/3 mm in thickness/width/length into an atmosphere at room temperature and normal pressure to yield continuous extrudates, which were extremely foamed. It was found that the resulting foams did not exhibit any orientation on their X-ray diffraction patterns at all, and it was impossible to produce pulp-like short fibers therefrom.

COMPARATIVE EXAMPLE 2

For the purpose of a comparison, a mixture of 100 g of an acrylonitrile copolymer having a chemical composition of 92.8% of acrylonitrile and 7.2% of methylacrylate and a viscosity average molecular weight of 102,000 and 35 g of water was compressed and placed into the sane extruder as employed in Example 1, and heated to 175° C. under applied pressure of 5 kg/cm$^2$ to form a complete melt. Then, the resulting melt, as it stood, was pressurized to 30 kg/cm$^2$ by operating the piston and extruded through the slit die having 0.5 mm/20 mm/3 mm in thickness/width/length into a pressure chamber at room temperature and under applied pressure of 2 kg/cm$^2$ to form tape-shaped, continuous extrudates. The extrudates were taken up at a rate of 10 m/min. According to an X-ray diffraction analysis, it was found that the tape-shaped extrudates had an orientation degree of 56%. It was, however, impossible to produce pulp-like short fibers therefrom.

Although the invention has been described with preferred embodiments, it is to be understood that variations and modifications may be employed without departing from the concept of the invention as defined in the following claims.

What is claimed is:

1. A heat- and chemical-resistant, pulp acrylic short fiber comprising a thickness distribution of 0.1 μm to 50 μm, a length distribution of 1 mm to 20 mm, a glass transition temperature of above 200° C., and insoluble in dimethylformamide at room temperature, produced by a process which comprises:

heating a mixture of water of 5% to 100% by weight and an acrylonitrile homopolymer or copolymer composed of acrylonitrile of above 70% by weight and a copolymerizable monomer of below 30% by weight and having a viscosity average molecular weight of 10,000 to 500,000 to temperatures above the melting temperature of the same mixture under enclosed conditions to form an amorphous melt;

cooling the resulting amorphous melt to a temperature between the melting and the solidifying temperatures ranging from 135° C. to 178° C. to obtain a supercooled melt phase;

extruding the resulting supercooled melt through a slit- or round-shaped extrusion die into an external atmosphere at room temperature and under normal pressure to give extrudates having a sectional structure in which microfibrils formed by solidification of the extrudates while water being automatically removed in the direction of extrusion after the extrusion and extended spaces from which water is drained off, are uniformly arranged in the direction of the extrusion in the enclosed inside of a surface, and a fibrous crystalline structure and a molecular orientation degree above 70% on an X-ray diffraction pattern;

passing the resulting continuous extrudates under tension through between two rollers, which is maintained at 100° C. to 180° C. and to which compressive force is applied, followed by drying and drawing; and subjecting the dried and drawn extrudates to heat-stabilization for 1 minute to 4 hours at 180° C. to 300° C., followed by cutting into said length distribution and beating mechanically.

2. The heat- and chemical-resistant, pulp acrylic short fiber according to claim 1, wherein the acrylonitrile copolymer is composed of acrylonitrile of above 85% by weight and at least a copolymerizable monomer of below 15% by weight.

3. The heat- and chemical-resistant, pulp acrylic short fiber according to claim 1, wherein the acrylonitrile homopolymer or copolymer has a viscosity average molecular weight of 50,000 to 350,000.

4. The heat- and chemical-resistant, pulp acrylic short fiber according to claim 1, wherein the mixture contains 10% to 50% by weight of water.

5. The heat- and chemical-resistant, pulp acrylic short fiber according to claim 1, wherein the heat-stabilization is carried out at a temperature ranging from 200° C. to 280° C. for 10 minutes to 3 hours.

* * * * *